US005676556A

United States Patent [19]

Yamaguchi et al.

[11] Patent Number: 5,676,556

[45] Date of Patent: Oct. 14, 1997

[54] LEVER-COUPLING TYPE CONNECTOR

[75] Inventors: Noboru Yamaguchi; Hiroki Takahashi, both of Shizuoka, Japan

[73] Assignee: Yazaki Corporation, Tokyo, Japan

[21] Appl. No.: 531,656

[22] Filed: Sep. 21, 1995

[30] Foreign Application Priority Data

Nov. 18, 1994 [JP] Japan ..... 6-284977

[51] Int. Cl.[6] ..... H01R 3/00

[52] U.S. Cl. ..... 439/157; 439/160

[58] Field of Search ..... 439/155, 157, 439/159, 160, 310, 372, 153, 488, 489

[56] References Cited

U.S. PATENT DOCUMENTS 5,174,785 12/1992 Endo et al. ..... 439/489
5,344,194 9/1994 Hatagishi et al. ..... 439/157
5,484,297 1/1996 Takahashi et al. ..... 439/157

FOREIGN PATENT DOCUMENTS 5-90843 12/1993 Japan .

*Primary Examiner*—David L. Pirlot
*Assistant Examiner*—Tho Dac Ta
*Attorney, Agent, or Firm*—Armstrong, Westerman, Hattori, McLeland & Naughton

[57] ABSTRACT

A lever-coupling type connector includes a pair of one and other connector housings to be fit into each other; a lever rotatably supported by the one connector housing and having a guiding groove; the other connector housing having an introducing protrusion to be engaged with the guiding groove; wherein the lever has a locking hook protruded from its supporting shaft, and the one connector housing includes an elastic locking piece having an elastic step to be engaged with the locking hook when the lever is rotated in a direction of coupling both connector housings. The lever is urged in an anti-fitting direction by the elastic force of the elastic locking piece in a state where both connector housings are completed fit into each other. This permits the state of semi-fitting of both connector housings to be easily recognized.

4 Claims, 3 Drawing Sheets

LEVER-COUPLING TYPE CONNECTOR

BACKGROUND OF THE INVENTION

1. Field of the Invention

The present invention relates to a lever-coupling type connector in which a pair of connector housings are coupled to each other and separated from each other by the operation of a lever rotatably provided on either one of the housings.

2. Description of the Prior Art

Fitting of a pair of multi-pole connectors, each having a large number of connection terminals requires a great amount of fitting force. Therefore, a lever-coupling type connector has been proposed in which connector housings can be easily connected to each other by application of a relatively small force using a lever.

In the lever-coupling type connector, one connector housing has a guiding groove in a lever and the other connector housing has a guiding pin adapted to be engaged by the guiding groove. In operation, after the guiding pin is located at the guiding groove, the former is advanced into the latter by the rotating operation of the lever, thereby fitting both connector housings into each other.

For the purpose of smoothly performing such a fitting operation, Japanese UM Preliminary Publn. No. 5-90843 proposes a lever-coupling type connector K in which relative positions of the guiding pin and the guiding groove are automatically held, as shown in FIG. 6.

One connector housing a, is provided with a lever b rotatably supported and a spring c attached by integration molding for urging the lever b attached by integration molding. The lever b is provided with an engagement portion d for positioning the guide groove e. The lever b is always urged so as to rotate clockwise. By abutment of the engagement portion d on the connector housing a, the lever b is so positioned that the intrusion inlet of the guide groove e and the guiding pin f are aligned with each other.

For this reason, even when an unexpected external force is applied to the lever b, if it is removed, the lever b will be immediately returned to a normal position.

When the lever b rotates counterclockwise, as shown in FIG. 7, both connector housings are caused to be deeply fit into each other. The prior art lever-coupling type connector K has the following defects. The spring c has only a small urging force since it is adapted to push the edge of the lever b in structure. The spring c, therefore, is useful in positioning the lever b, but cannot detect that both connector housings are in a semi-fitting state. Thus, the spring c cannot contribute to an improvement of the reliability of the fitting process.

SUMMARY OF THE INVENTION

An object of the present invention is to provide a lever-coupling type connector which can detect the semi-fitting condition of a pair of connector housings by provision of a locking hook at a lever supporting portion which is to be engaged with an elastic piece provided at the connector housing.

In the lever-coupling type connector according to a present invention, the locking hook on the lever is engaged with an elastic locking piece on the connector housing so that the lever is urged in an anti-fitting direction by the elastic locking piece. In the state of semi-fitting of the connector housings, the lever is held in a state in which it is sprung up by the elastic force of the elastic locking piece. Therefore, observance of the position of the lever permits the coupling state between both connector housings to be confirmed. This improves workability of coupling the connector housings, thereby also improving the reliability of the connector. Changing the position of the locking hook to be provided on the lever permits the return position of the lever to be easily adjusted.

The above and other objects and features of the present invention will be more apparent from the following description taken in conjunction with the accompanying drawings.

DESCRIPTION OF THE PREFERRED EMBODIMENTS

Figure 1:
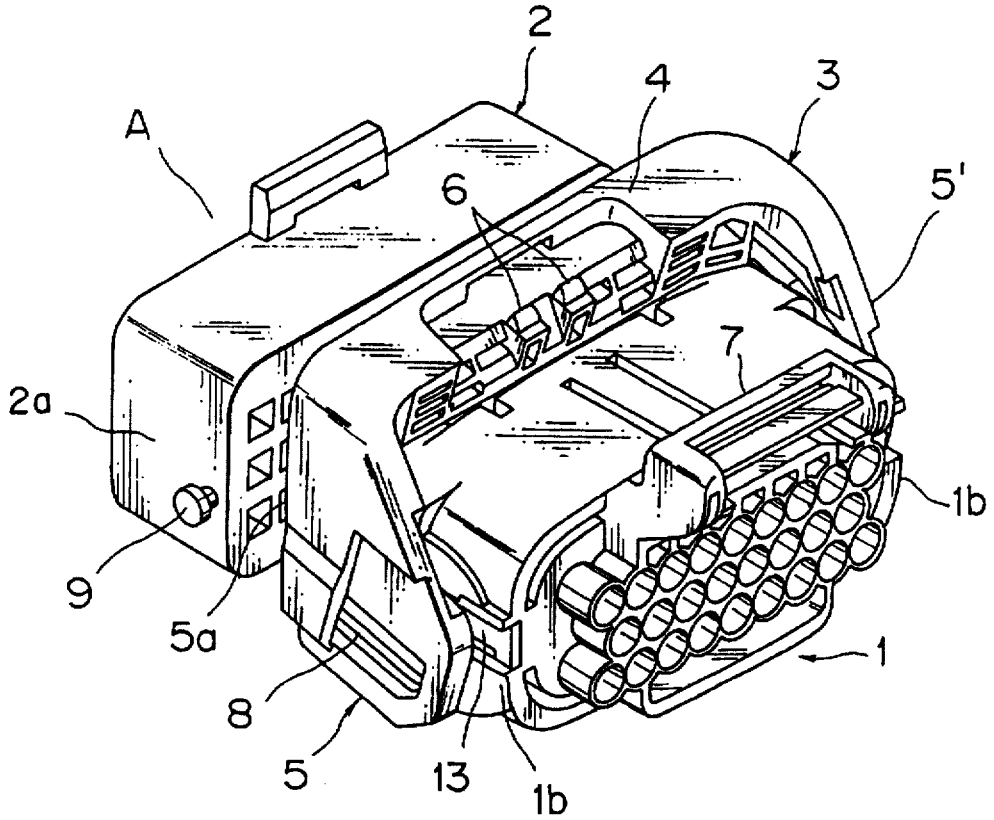
FIG. 1 is a perspective view of a lever-coupling type connector according to an embodiment of the present invention.
Figure 2:
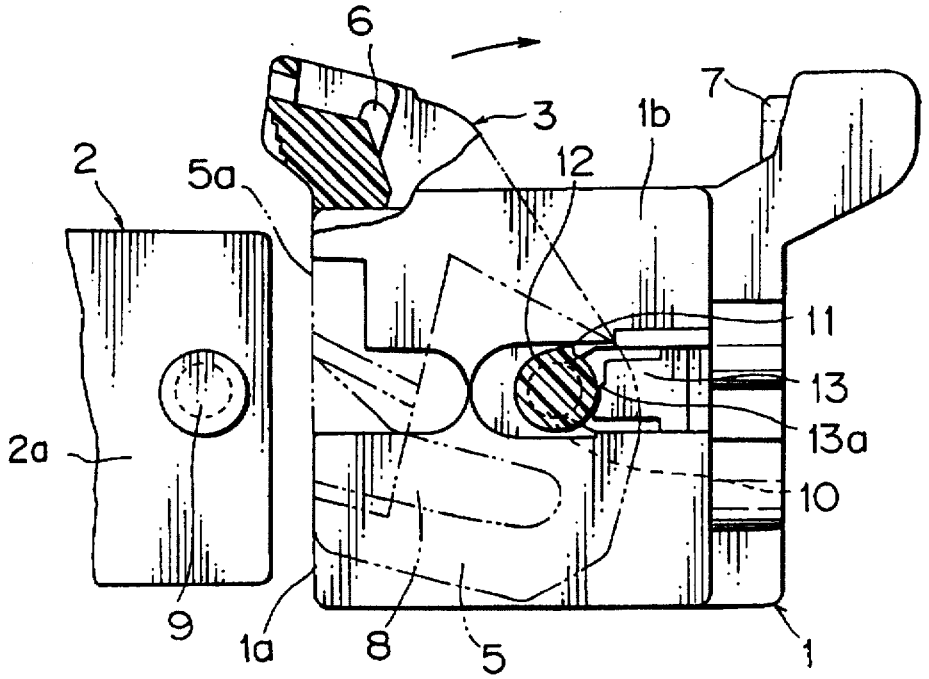
FIG. 2 is a side sectional view showing the main part of the lever-coupling type connector of FIG. 1.

FIG. 1 is a perspective view of a lever-coupling type connector A according to an embodiment of the present invention. FIG. 2 is a side view thereof.

The lever-coupling type connector A includes a pair of connector housings 1 and 2 to be fit into each other. The one connector housing 1 is provided with a lever 3 rotatably supported thereto.

Each of the connector housings 1 and 2 includes a large number of terminal chambers having openings on a front surface 1*a* of the housing 2. Rotation of the lever 3 fits the connector housing 2 into the opening portion of the connector housing 1 so that the housings 1 and 2 are coupled to each other. The lever 3 has a generally C-shape having supporting portions 5 and 5' on each end of an operation portion 4. A locking tongue 6 protrudes rearwardly at the center of the operation portion 4. The lever 3 is adapted to be locked by urging the locking tongue 6 into engagement with the shoulder of locking member 7 provided at the rear end of the connector housing 1.

Since the supporting portions 5 and 5' are formed symmetrically, an explanation will be given of only the one supporting portion 5. The supporting portion 5 has a guiding groove 8 cut from its edge 5*a* which serves to guide an introducing protrusion 9 provided on the side wall 2*a* of the other connector housing 2.

The supporting portion 5 has an inwardly protruded supporting shaft 10. Fitting a shaft hole (not shown) formed in the side wall of the connector housing 1 with the supporting shaft 10 thereby rotatably supporting the lever 3.

The supporting shaft 10 of the supporting portion 5 has a disk-shaped locking flange 12 on the peripheral surface. The locking flange 12 has a locking hook 11 projecting radially from the surface of the locking member.

On the outer wall 1*b* of each side of the connector housing 1, an elastic locking piece 13 formed by cutting the external wall 1*b* is so formed that its free end is directed to the supporting shaft 10.

At the free end of the elastic locking piece 13, a locking step 13*a* is formed which is adapted to be engaged by the locking hook 11 of the locking flange 12 provided at the supporting portion 5 when the lever 3 is rotated in a direction in which the connector housings 1 and 2 are fit into each other.

With the introducing protrusion 9 of the connector housing 2 being located at the opening end of the guiding groove 8 of the connector housing 1, when the lever 3 is rotated in the direction indicated by the arrow in FIG. 2 direction, the connector housings 1 and 2 are coupled to each other.

Figure 3:
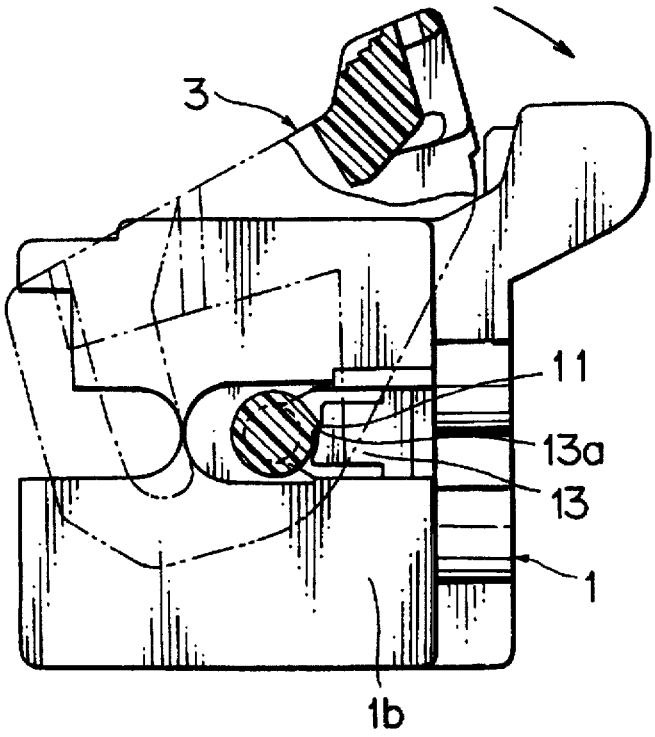
FIG. 3 is a view showing the coupling state of a locking hook and an elastic locking piece in the lever-coupling type connector of FIG. 1.

In the performance of such lever operation, before the connector housings 1 and 2 are completely fit into each other, as shown in FIG. 3, the locking hook 11 of the locking flange 12 abuts the locking step 13*a* of the elastic locking piece 13.

Figure 4:
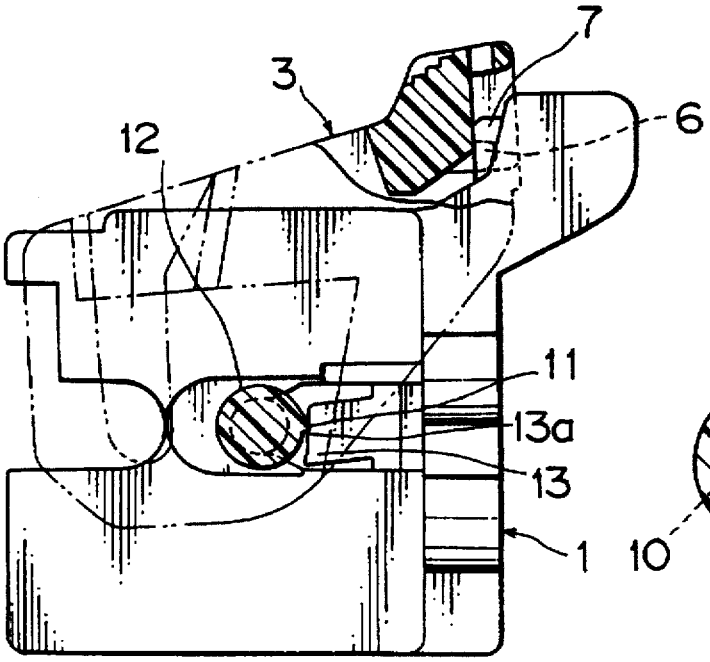
FIG. 4 is a view showing the coupling state of a locking hook and an elastic locking piece in a state where a pair of connector housings are completely coupled to each other in the lever-coupling type connector of FIG. 1.

When the lever 3 is rotated in the direction of the arrow in FIG. 3, the locking hook 11 presses the locking step 13*a*. Thus, as shown in FIG. 4, when both housing connectors 1 and 2 are fit into each other the locking piece 13 is in a state in which it is deflected downwards, and the locking tongue 6 of the lever 3 is logged in engagement with the locking shoulder defined by the underside of the member 7 of the connector housing 1. As a result, the lever 3 is locked.

Figure 5:
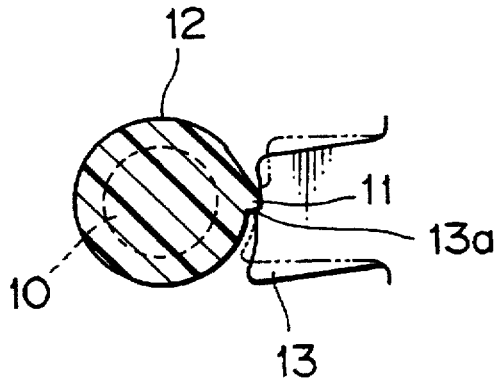
FIG. 5 is a view showing the urged state of the elastic locking piece in FIG. 4.
Figure 6:
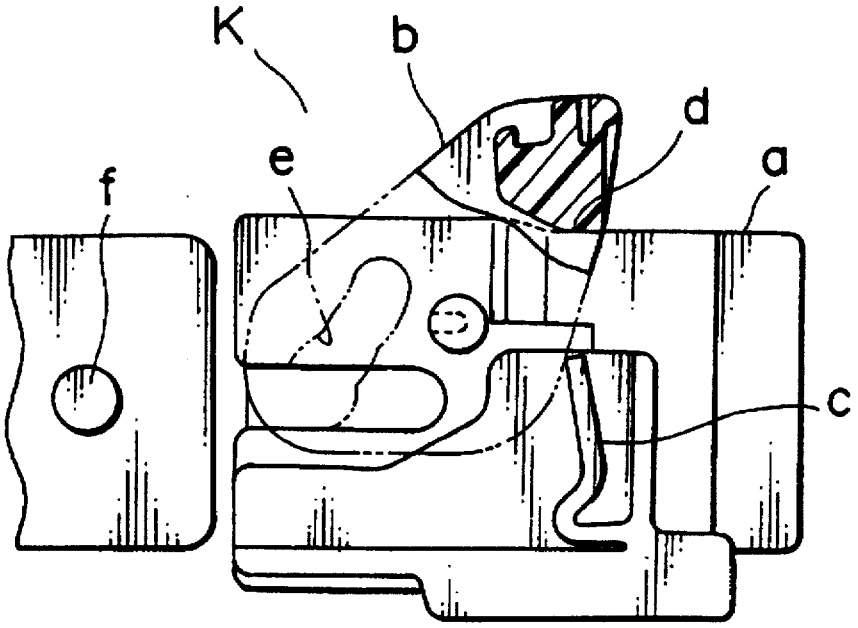
FIG. 6 PRIOR ART
FIG. 6 is a side view of a conventional lever-coupling type connector.
Figure 7:
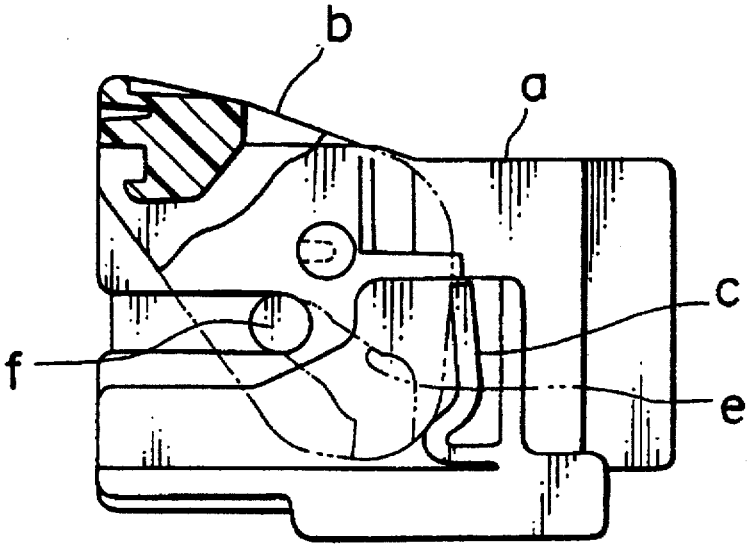
FIG. 7 PRIOR ART
FIG. 7 is a view showing the state where a pair of conventional connector housings have been completely coupled to each other.

FIG. 5 shows, in a large scale, the state of the elastic locking piece 13 and the locking hook 11 when the connector housings are in their completely fitted, locked condition. As seen from the figure, the elastic locking piece 13, which is held in a downwardly deflected state, urges the locking hook 11 on the locking member 12 so that the locking is rotated counter-clockwise in the anti-fitting direction thereby urging the locking tongues 6 against the shoulder of the locking member 7. When the locking tongue 6 of the lever 3 is released from the locking member 7 of the connector housing 1 the lever 3 is caused to spring up by the elastic force of the elastic locking piece 13 acting against the locking hook 11.

Therefore, it can be clearly confirmed whether or not the connector housings 1 and 2 have been completely fit into each other according to whether or not the lever 3 is located at its sprung-up position. Specifically, if the lever 3 is located at the spring-up position, it is apparent that the lever 3 is not yet locked to the connector housing 1 and the connector housing are not completely fitted together. Such a semi-fitting state can therefore be easily confirmed.

The return position (spring-up position) of the lever 3 can be easily changed by changing the position of the locking hook 11 formed on the locking member 12.

What is claimed is:

1. A lever-coupling type connector comprising:

a pair of cooperating connector housings to be connected to each other;

a lever rotatably supported by supporting shafts mounted for rotation to one of said connector housings and having a guiding groove;

said other connector housing having a protrusion operative to be engaged by said guiding groove on said lever; and said connector housings being drawn into corrected relation with respect to each other by a camming action imposed on said protrusion during rotation of said lever upon introduction of said protrusion into said guiding groove, wherein said supporting shafts mounting said lever include means forming a locking hook protruding radially therefrom, and said one connector housing includes an elastic locking piece having a locking step adapted to be engaged by said locking hook when said lever is rotated in a direction of coupling both connector housings.

2. A lever-coupling type connector according to claim 1, wherein said elastic locking piece is a cantilever extending from said one connector housing.

3. A lever-coupling type connector according to claim 1, wherein said locking hook is engaged by the locking step to hold the lever in a spring-up position when said connector housings are in a semi-fitting state.

4. A lever-coupling type connector according to claim 1, wherein said lever contains locking tongue means adapted to engage a locking member on said one connector housing when said connector housings are in a completely fitted state, said locking piece, upon engaging said locking hook, being operative to urge said locking tongue means lockingly against said locking member.

* * * * *